US009883294B2

(12) United States Patent
Blessing et al.

(10) Patent No.: US 9,883,294 B2
(45) Date of Patent: Jan. 30, 2018

(54) CONFIGURABLE HEARING SYSTEM

(71) Applicant: Bernafon A/G, Bern (CH)

(72) Inventors: Uwe Blessing, Bern (CH); Carsten Braun, Berlin (DE); Remo Vaterlaus, Berne (CH); Christian Glück, Berne (CH)

(73) Assignee: BERNAFON A/G, Bern (CH)

( * ) Notice: Subject to any disclaimer, the term of this patent is extended or adjusted under 35 U.S.C. 154(b) by 0 days.

(21) Appl. No.: 14/872,713

(22) Filed: Oct. 1, 2015

(65) Prior Publication Data

US 2017/0099550 A1 Apr. 6, 2017

(51) Int. Cl.
*H04R 25/00* (2006.01)

(52) U.S. Cl.
CPC ..... *H04R 25/50* (2013.01); *H04R 25/43* (2013.01); *H04R 25/554* (2013.01); (Continued)

(58) Field of Classification Search
CPC ..... H04R 2225/39; H04R 25/405; H04R 25/407; H04R 25/43; H04R 25/505 (Continued)

(56) References Cited

U.S. PATENT DOCUMENTS 4,992,966 A * 2/1991 Widin ..... H04R 25/70 379/52
6,229,900 B1 * 5/2001 Leenen ..... H04R 25/558 381/312

(Continued)

FOREIGN PATENT DOCUMENTS

DE 196 33 996 A1 2/1998
DE 203 13 063 U1 4/2004
DE 10 2013 111 295 A1 4/2015

OTHER PUBLICATIONS

Kraus, "Das Ist Weltweit Einzigartig' Carsten Braun über die Duale Anpassung," AudioInfos, No. 159, Jul. 2014, Translation (by KIMJ, HJVN of Oticon A/S), pp. 8-12.

*Primary Examiner* — Sunita Joshi
(74) *Attorney, Agent, or Firm* — Birch, Stewart, Kolasch & Birch, LLP

(57) ABSTRACT

The application relates to a configurable hearing device such as a hearing aid comprising an input transducer adapted to transform an input sound signal to an electrical input signal; a memory storing at least two different performance categories, each comprising a group of technical features, the group of technical features of each of the at least two different performance categories being at least partially overlapping and each technical feature of the group of technical features being defined by a selectable range and/or parameter settings; a signal processing unit adapted to access the memory and to process the electrical input signal in accordance with an active performance category selectable from the at least two different performance categories, the signal processing unit providing a processed electrical signal; and an output transducer adapted to transform the processed electrical signal to an output signal producing a hearing perception to a user of the hearing device. The invention may e.g. be used for the fitting of hearing aids to first time users, where a choice between different hearing aid models having different performance must be made.

17 Claims, 7 Drawing Sheets

(52) U.S. Cl.
CPC .... *H04R 2225/025* (2013.01); *H04R 2225/39* (2013.01); *H04R 2225/41* (2013.01); *H04R 2430/20* (2013.01)

(58) Field of Classification Search
USPC ..... 381/312–321
See application file for complete search history.

(56) References Cited

U.S. PATENT DOCUMENTS

2007/0237346 A1* 10/2007 Fichtl ..... H04R 25/70 381/314
2010/0027820 A1* 2/2010 Kates ..... G10L 25/00 381/312

* cited by examiner

| | | |
|---|---|---|
| PC1 | PCP1(1), PCP1(2), …, PCP1(NPCP1) | [top level #1] |
| TF11 | TFP11(1),TFP11(2), …, TFP11(NTF11) | |
| TF12 | TFP12(1),TFP12(2), …, TFP12(NTF12) | |
| …. | | |
| TF1NTFPC1 | ….. | |
| PC2 | PCP2(1), PCP2(2), …, PCP2(NPCP2) | [top level #2] |
| TF21 | TFP21(1),TFP21(2), …, TFP21(NTF21) | |
| TF22 | TFP22(1),TFP22(2), …, TFP22(NTF22) | |
| ….. | | |
| TF1NTFPC2 | …... | |
| ….. | | |
| PCN | PCPN(1), PCPN(2), …, PCPN(NPCPN) | [low level #NLL] |
| TFN1 | TFPN1(1),TFPN1(2), …, TFPN1(NTFN1) | |
| TFN2 | TFPN1(1),TFPN2(2), …, TFPN1(NTFN2) | |
| …. | | |
| TF1NTFPCN | …... | |

MEM

FIG. 4

| Technical feature/Performance Category | PC1 | PC2 | PC3 | PC4 | PC5 |
|---|---|---|---|---|---|
| Adaptive Noise Reduction Plus | 5 states Default "med" | 4 states Default "med" | 3 states Default "minimum" | 2 states Default "med" | 2 states Default "med" |
| Reverberation Reduction | + | - | - | - | - |
| True Directionality | + | - | - | - | - |
| Environment Optimizer | 5 states | 2 states | - | - | - |
| Frequency Bandwidth | 10 kHz | 10 kHz | 8 kHz | 8 kHz | 8 kHz |
| Soft Noise Management | 3 states | 3 states | 3 states | 2 states | 2 states |
| Transient Noise Reduction | + | + | + | - | - |
| Frequency Composition | + | + | + | + | - |
| Adaptive Directionality | + | + | + | + | - |

FIG. 5A

| ↓ Technical feature/ Performance category → | PC1 | PC2 | PC3 | PC4 | PC5 |
|---|---|---|---|---|---|
| Adaptive Noise Reduction + (5 states) | PCP=1 TFP=5 | PCP=1 TFP=4 | PCP=1 TFP=3 | PCP=1 TFP=2 | PCP=1 TFP=2 |
| Reverberation reduction | 1 | 0 | 0 | 0 | 0 |
| True Directionality | 1 | 0 | 0 | 0 | 0 |
| Environment Optimizer | PCP=1 TFP=5 | PCP=1 TFP=2 | 0 | 0 | 0 |
| Frequency Bandwidth 10 kHz | 1 | 1 | 0 | 0 | 0 |
| Frequency Bandwidth 8 kHz | 0 | 0 | 1 | 1 | 1 |
| Soft Noise Management (3 states) | PCP=1 TFP=3 | PCP=1 TFP=3 | PCP=1 TFP=3 | PCP=1 TFP=2 | PCP=1 TFP=2 |
| Transient Noise Reduction | 1 | 1 | 1 | 0 | 0 |
| Frequency Composition | 1 | 1 | 1 | 1 | 0 |
| Adaptive Directionality | 1 | 1 | 1 | 1 | 0 |
| Bluetooth Communication | 1 | 1 | 1 | 0 | 0 |
| Inductive Communication | 0 | 1 | 1 | 1 | 1 |

FIG. 5B

CONFIGURABLE HEARING SYSTEM

SUMMARY

A Configurable Hearing System

In an aspect of the present application, a configurable hearing system is provided. The configurable hearing system, comprises

- a hearing device, e.g. a hearing aid, adapted to be worn by a user and adapted for processing an input sound signal and/or a directly received auxiliary audio input signal, and providing an enhanced output signal, the hearing device comprising
- a forward signal path comprising
  - an input unit comprising one or more input transducers for providing respective one or more electric input audio signals representative of said input sound signal and/or one or more wireless receivers for providing respective one or more directly received auxiliary audio input signals;
  - a memory storing at least two different performance category parameter settings each defining a different performance category, each performance category comprising a specific set of technical features;
  - a configurable signal processing unit adapted to access the memory and for selecting and processing one or more of said electric input audio signals and/or one or more of said directly received auxiliary audio input signals, based on a currently selected one of said at least two different performance category parameter settings, said configurable signal processing unit providing an enhanced audio signal;
- an output unit for providing said enhanced output signal as stimuli perceivable by the user as sound based on said enhanced audio signal or a signal derived therefrom.

The configurable hearing system further comprises a user interface configured to allow a user to select any one of said at least two different performance category parameter settings to be active at a given time, wherein each performance category comprises a specific combination of technical features, and wherein the hearing device is configured to provide that at least some of said technical features can be enabled or disabled as part of the specific performance category parameter setting.

Thereby a user gets the opportunity—during trial period (e.g. of predefined length) and with a single hearing device—to compare the perception of different hearing device models (corresponding to different performance categories, e.g. different price points) in different acoustic environments. This may help a user (in particular a first time user) to choose an appropriate one among a number of hearing device (e.g. hearing aid) models.

In an embodiment of the configurable hearing system, at least some technical features are common for all performance categories.

In an embodiment, the specific sets of technical features defining the different performance categories are at least partially overlapping.

In an embodiment, one top performance category comprises all available technical features, and all other performance categories each comprises a different subset of the technical features of the top performance category. In other words: In an embodiment, the union of all technical features of all performance categories is equal to the technical features of a top set of performance categories comprising a top set of technical features, e.g. all available technical features of the configurable hearing system. In an embodiment, the performance categories ($PC_1$, $PC_2$, . . . , $PC_N$) are be grouped from a low to a high performance level ($PFL_1$, $PFL_2$, . . . , $PFL_N$) so that the performance categories (for a given acoustic environment) is intended to provide an increased quality of the perceived output stimuli, the higher the performance group number.

In an embodiment, the configurable hearing system is configured to provide that at least two of the performance categories (e.g. PC1 and PC2) of the configurable hearing system each comprises at least one technical feature that is not part of the intersection of the two sets of technical features. In other words: In an embodiment, the configurable hearing system comprises at least two performance categories, PC1 and PC2, each comprising a set of different technical features STF1 ($TF_{11}$, $TF_{12}$, . . . , $TF_{1P}$, P being the number of technical features of setting STF1) and STF2 ($TF_{21}$, $TF_{22}$, . . . , $TF_{2Q}$, Q being the number of technical features of setting STF2), respectively, for which the relative complement of STF1 in STF2 as well as the relative complement of STF2 in STF1 comprises at least one technical feature (e.g. $TF_{1p}$ and $TF_{2q}$), respectively. In still other words, none of the performance categories is a top performance category (comprising a top set of technical features, e.g. all available technical features) from which the sets of technical features of all other performance categories are derived.

For each performance category, 'style specific' variations' are possible, which take into account the limitations of the particular style (feedback, maximum power output (MPO), etc.). In an embodiment, the configurable hearing system (e.g. the hearing device) is adapted to represent a specific style of hearing device, e.g. hearing aid.

In an embodiment, the hearing system, e.g. the hearing device (such as a hearing aid), e.g. the input unit, comprises one or more input transducers (e.g. microphones) for picking up the input sound and providing the electric input audio signal. In an embodiment, the hearing system, e.g. the hearing device (such as a hearing aid), e.g. the input unit, comprises one or more wireless receivers of a signal representing sound, e.g. configured to receive a signal representing said input sound or another audio signal, e.g. a streamed audio signal from an audio delivery device, e.g. a telephone or an entertainment device. In an embodiment, the wireless receiver(s) is/are configured to allow reception of a signal representing sound from a wireless transmitter according to a standardized and/or proprietary scheme, e.g. utilizing one or more of the standardized frequency ranges, e.g. ISM (ISM=Industrial, Scientific and Medical), e.g. such frequency ranges as defined by the International Telecommunication Union, ITU. In an embodiment, the wireless receiver(s) is/are configured to allow reception of a signal representing sound from a wireless transmitter based on radiated fields, e.g. transmitted according to Bluetooth, e.g. classic Bluetooth and/or e.g. according to Bluetooth Low Energy or similar standardized or proprietary scheme. In an embodiment, the wireless receiver is configured to allow reception of a signal representing sound from a wireless transmitter based on near-field communication, e.g. based on a near-field magnetic inductive coupling between antenna coils, e.g. transmitted according to a standardized scheme such as NFC (ISO/IEC 14443 and ISO/IEC 18000-3), etc., or according to a proprietary scheme. In an embodiment, the hearing system comprises two or more wireless receivers. In an embodiment, at least one wireless receiver is configured to allow reception of a signal representing sound from a wireless transmitter based on radiated fields, and at least one wireless receiver is configured to allow reception of a signal representing sound from a wireless transmitter based on near-field communication. In an embodiment, the hearing system, e.g. the hearing device (such as a hearing aid), e.g. the input unit, comprises a (possibly configurable) filter bank for providing an electric input signal in a number of frequency bands. In an embodiment, the number of frequency bands is configurable, e.g. to 1 or to more than 1, e.g. to a number below a predefined maximum, e.g. to less than or equal to 64 or 256.

In an embodiment, at least one of the performance categories has a technical feature defining a bandwidth of the electric input audio signal that is different from another of the performance categories. In an embodiment, a performance category comprises a technical feature defining a bandwidth of the electric input audio signal at or below 8 kHz. In an embodiment, a performance category comprises a technical feature defining a bandwidth of the electric input audio signal larger than 8 kHz, e.g. 10 kHz or larger.

In an embodiment, at least one of the performance categories has a technical feature defining an ability to receive wirelessly transmitted signal according to a specific transmission protocol (e.g. Bluetooth, such as Bluetooth Low Energy or a related standardized or proprietary scheme).

In an embodiment, the technical features comprises at least one of

- providing a specific sampling rate of the input sound signal,
- providing a specific number of electric input audio signals,
- providing a specific bandwidth of said electric input audio signal(s),
- providing a specific number of directly received auxiliary audio input signals,
- providing an ability of receiving an audio signal from a wireless transmitter,
- providing said electric input audio signal(s) and/or said directly received auxiliary audio input signals in a specific number of frequency bands, or a combination thereof.

In an embodiment, the sampling rate of the input sound signal is smaller than or equal to 12 kHz, such larger than 12 kHz and smaller than or equal to 20 kHz. In an embodiment, a specific number of electric input audio signals is 1 or 2 or 3 or more. In an embodiment, a specific number of directly received auxiliary audio input signals is 0, or 1 or 2 or more. In an embodiment, the technical features related to characteristics of the electric input audio signal comprise a bandwidth of said electric input audio signal. In an embodiment, a specific performance category comprises a technical feature related to the configurable input unit wherein the bandwidth of the electric input audio signal is relatively low, e.g. ≤6 kHz, such as ≤5 kHz. In an embodiment, a specific performance category comprises a technical feature related to the configurable input unit wherein the bandwidth of the electric input audio signal is relatively high, e.g. ≥6 kHz, such as ≥8 kHz. In an embodiment, a specific performance category comprises a technical feature related to receiving a signal representing an audio signal from a wireless transmitter, e.g. according to a specific standardized or proprietary scheme, e.g. in a bandwidth around 2.4 GHz or 5.8 GHz, e.g. according to a classic Bluetooth, or Bluetooth Low Energy or similar standardized or proprietary scheme. In an embodiment, a specific performance category comprises a technical feature related to receiving an audio signal from a wireless transmitter, e.g. based on near-field communication, e.g. in a bandwidth below 100 MHz, such as below 10 MHz, e.g. according to a standardized or proprietary scheme. In an embodiment, the number of frequency bands in which the electric input audio signal and/or said directly received auxiliary audio input signals is provided is 1. In an embodiment, the number of frequency bands is 2 or more, e.g. 8 or more, such as 16 or more.

In an embodiment, the selected performance category and its specific set of technical features provides a specific selection of electric input audio signals and directly received auxiliary audio input signals and provides a specific processing thereof.

In an embodiment, each of the performance categories and their corresponding specific set of technical features provides a specific combination of processing algorithms with specific parameter settings that is intended for use in all acoustic situations. In an embodiment, the specific combination of processing algorithms with specific parameter settings that is intended for use in all acoustic situations corresponds to or comprises a 'multi-environment' program of a hearing aid.

In an embodiment, the configurable hearing system is configured to provide that each of the performance categories and their corresponding specific set of technical features provides a multitude of specific settings of parameters of a specific processing algorithm or a combination of processing algorithms, each setting being intended for use in a specific acoustic environment and/or in a specific mode of operation of the hearing system.

In an embodiment, the configurable hearing system, e.g. the hearing device (e.g. a hearing aid), comprises an interface to a programming system for uploading or modifying technical features, such as parameter settings of one or more of said performance categories to the memory. In an embodiment, enablement of receiving a signal representing sound from a wireless transmitter according to a specific standardized or proprietary scheme is facilitated via the programming interface. In an embodiment, the programming interface allows a fitting system to be operationally connected to the configurable hearing system. In an embodiment, the configurable hearing system comprises a programming device, such as a fitting system (e.g. for a hearing aid).

In an embodiment, the configurable hearing system comprises a time control unit allowing said control by the user to select any one of said multitude of different selectable performance categories to be active to be limited to a predefined or dynamically updatable functional time period. In an embodiment, the predefined functional time period is set to a period less than 3 months, e.g. between 1 and 6 weeks. In an embodiment, the configurable hearing system is configured to stop working when the functional time period has expired. In an embodiment the configurable hearing system is configured to disable the output unit (mute, provide no output sound) of the hearing device when the functional time period has expired. In an embodiment the configurable hearing system is configured to stop working at the first power up of the hearing device after the functional time period has expired (so as not to stop working during a normal use of the hearing device/system).

In an embodiment, the configurable hearing system comprises a data logger for logging the users' selection of performance categories. In an embodiment, the data logger is adapted to log data related to one or more of user specific selections (e.g. of specific performance categories), timing information related to such selections (e.g. time of day and/or duration), acoustic environments, etc. In an embodiment, data regarding a selected performance category and the time spent in the performance category and/or a classifier of the acoustic environment are logged (stored in a memory). In an embodiment a preferred performance category of the user is determined from the logged data.

In an embodiment, the configurable hearing system is adapted to allow a user to indicate a an opinion on a given performance category selected at a given point in time (and/or in a given acoustic environment) via the user interface.

In an embodiment, the user interface forms part of a separate remote control device, e.g. integrated with an APP of a smartphone or similar device.

In an embodiment, a performance category corresponds to a price category of a particular hearing device model.

In a further aspect, a configurable hearing device such as a hearing aid is furthermore provided. The configurable hearing device comprises

- an input transducer adapted to transform an input sound signal to an electrical input signal;
- a memory storing at least two different performance categories, each comprising a group of technical features, the group of technical features of each of the at least two different performance categories being at least partially overlapping and each technical feature of the group of technical features being defined by a selectable range and/or parameter settings;
- a signal processing unit adapted to access the memory and to process the electrical input signal in accordance with an active performance category selectable from the at least two different performance categories, the signal processing unit providing a processed electrical signal; and
- an output transducer adapted to transform the processed electrical signal to an output signal producing a hearing perception to a user of the hearing device.

In an embodiment, the hearing device is adapted to be positioned at or in an ear or fully or partially implanted in the head of a user.

In an embodiment, each of the at least two different performance categories comprise a group of technical features representative of a different hearing aid model. In an embodiment, the at least two different hearing aid models are selected from different hearing aid models from the same product family. In an embodiment, the at least two different performance categories are representative of at least two differently priced hearing aid models from same product family.

In an embodiment, the configurable hearing device comprises a time control unit adapted to define a usage time duration for which the signal processing unit is adapted to process the electrical input signal in accordance with one of the at least two different parameter configurations.

In an embodiment, the configurable hearing device further comprises an interface comprising a user interface adapted to receive a user selection for activating one of the at least two different performance categories. In an embodiment, the user interface form part of the hearing device. In an embodiment, the user interface form part of a separate device, e.g. a remote control device, e.g. a smartphone. In an embodiment, the user interface comprising a direct (e.g. on the hearing device) or an indirect (e.g. through a smartphone) user interface is adapted to receive a user satisfaction score for one or more of the at least two performance categories.

In an embodiment, the configurable hearing device further comprises a data logger adapted to log data comprising duration and/or time stamps indicating an active mode of one of the at least two different performance categories and/or a performance category specific user satisfaction score.

In an embodiment, the configurable hearing device further comprises an environment classification unit adapted to classify the user's acoustic environment as a classification signal.

In an embodiment, the data logger is adapted to log data further comprising the classified acoustic environment for which the user satisfaction score is entered and/or the performance category used for the classified acoustic environment.

In an embodiment, the signal processing unit is adapted to access the active performance category and/or to receive the classification signal from the environment classification unit for controlling adaptive directionality of the input transducer.

In an embodiment, the data logger is active during the usage time duration.

In an embodiment, the configurable hearing device is adapted to provide that the usage time duration is extendible in response to a user's extension request.

In an embodiment, the configurable hearing device further comprises a receiving unit adapted to receive, in response to a user's service request, an executable activation instruction, which when executed alters at least one performance category to enable or disable a technical feature and/or to extend or limit the selectable range and/or parameter setting.

In an embodiment, the alteration based on the activation instruction is for a predefined time, wherein the predefined time≤usage time duration.

In an embodiment, the technical features comprise adaptive directionality, bandwidth, frequency compression, adaptive noise reduction. In an embodiment, the range comprises a bandwidth range. In an embodiment, the parameters settings comprises an enabling a choice between an OMNI- and a DIR mode, the enabling of reception of a direct electric input from an audio delivery device (streamed audio), e.g. from a wireless interface, etc.

In an embodiment, the configurable hearing device comprises a transmitter adapted to transmit the log data to an external electronic device and/or to database.

In an embodiment, at least one performance category of the at least two different performance categories comprises a plurality of context dependent programs comprising a subset of the features and range and/or parameter settings of the features and range and/or settings specific to the at least one performance category, wherein the context dependent programs are at least partially overlapping across the at least two performance categories.

In an embodiment, the configurable hearing device is adapted to compare user satisfaction scores and logging data for a given context dependent program from different performance categories. In an embodiment, the hearing device is adapted to—at a given point in time—to determine the context dependent programs and their associated performance category that are preferred by the user from the user satisfaction scores and/or the logging data.

In an embodiment, the configurable hearing system comprises a plurality of hearing devices, a plurality of users with the same at least two different performance categories, a collective log database comprising a plurality of log data, duration of settings, etc.

In an embodiment, the configurable hearing device comprises or is connectable to a server allowing at least a part of collective log data being shared among the plurality of users over a platform such as a client application running on an electronic device or at least a part of log data shared with the user of the hearing device or at least a part of the collective log data or log data being shared with an audiologist.

In an embodiment, the hearing device comprises a listening device, e.g. a hearing aid, e.g. a hearing instrument, e.g. a hearing instrument adapted for being located at the ear or fully or partially in the ear canal of a user, e.g. a headset, an earphone, an ear protection device or a combination thereof.

In an embodiment, configurable hearing system comprises another hearing device. In an embodiment, the hearing system comprises two hearing devices adapted to implement a binaural hearing system, e.g. a binaural hearing aid system.

In an embodiment, the configurable hearing system comprises an auxiliary device. In an embodiment, the configurable hearing system is adapted to establish a communication link between the hearing device and the auxiliary device to provide that information (e.g. control and status signals, possibly audio signals) can be exchanged or forwarded from one to the other.

In an embodiment, the auxiliary device is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing device. In an embodiment, the auxiliary device is or comprises a remote control for controlling functionality and operation of the hearing device(s). In an embodiment, the function of a remote control is implemented in a smartphone, the smartphone possibly running an APP allowing to control the functionality of the audio processing device via the smartphone (the hearing device(s) comprising an appropriate wireless interface to the smartphone, e.g. based on Bluetooth or some other standardized or proprietary scheme).

In an embodiment, the auxiliary device comprises a programming device, e.g. a fitting system for fitting the hearing device (e.g. a hearing aid) according to a user's needs, e.g. a user's hearing impairment.

In an embodiment, the configurable hearing system comprises a fitting system connectable to the hearing device via a programming interface. In an embodiment, the fitting system adapted to fit a number of different performance categories to a particular user's needs in one fitting procedure. In an embodiment, different performance categories, different technical features (different performance category parameter settings), different technical feature parameter setting (different ranges, and/or parameter values, e.g. of one or more algorithms) can be loaded into the hearing device from the fitting system via the programming interface.

Use:

In an aspect, use of a configurable hearing system or device as described above, in the 'detailed description of embodiments' and in the claims, is moreover provided. In an embodiment, use is provided allowing a user—during trial period (e.g. of predefined length) to compare the perception of different hearing device models (corresponding to different performance categories, e.g. different price points) in different acoustic environments. This is enabled by a simple switching—via a user interface—between different performance categories whose characteristics are stored in a memory of the configurable hearing system and allowing a user to directly compare the result thereof one after the other (possibly repeatedly) to get a reasoned opinion of the preferences of the user in that acoustic environment. In an embodiment, use of the system wherein the hearing device is a hearing aid (adapted to compensate for a hearing impairment of the user) is provided.

Definitions

A specific performance category is e.g. defined by a specific (fixed) set of technical features.

A set of technical features comprises a number of different technical features. In an embodiment of the configurable hearing system, at least some of the technical features can be enabled or disabled as part of a specific performance category parameter setting. Thereby different performance categories can be provided (each exhibiting (being defined by) different specific performance category parameter settings).

A specific performance category parameter setting is characterized by a number of on-off variables for enabling or disabling specific technical features.

In general, a technical feature has a technical and/or audiological purpose (e.g. improved speech intelligibility, improved sound quality, reduced acoustic feedback, etc.). In general, a technical feature solves a specific technical problem of the hearing device. In general, several different technical features may be associated with the same audiological purpose (e.g. improved speech intelligibility) but addresses different technical problems (e.g. spatial filtering, noise reduction, user specific frequency and/or level dependent amplification, bandwidth of electric input audio signal, etc.). In an embodiment, the configurable hearing system comprises a number of different variants of technical features associated with solving the same technical problem (e.g. spatial filtering being fixed or adaptive and/or based on different algorithms), such different variants of technical features providing different solutions (e.g. different solutions of different complexity). Different variants of a technical feature may form part of different performance categories. Typically, a specific technical feature (or variant of a technical feature) of a performance category is defined and/or controlled by a specific technical feature parameter setting.

A specific technical feature parameter setting is defined by a number of ranges, and/or parameter values, e.g. of one or more algorithms. Ranges may e.g. refer to frequency ranges, level ranges, gain ranges, time constant ranges, etc. Parameter values may refer to constants or specific values of parameters of a logic expression, such constants or values e.g. relating to time constants, levels, frequencies, maximum or minimum gain or attenuation values, rates of change of specific parameters, step sizes, convergence rates, etc. The term 'parameters' in connection with specific processing algorithms is taken to mean 'processing parameters' or parameters related to the effect of processing of a signal by specific processing algorithms. The terms are used interchangeably in the present disclosure. A combination of a number of specific technical features (each comprising a specific 'technical feature parameter setting') may constitute a program of an ordinary hearing device, e.g. a specific program configured for a specific acoustic situation, e.g. for listening to music, or for a one-to-one conversation situation, or for a multi-speaker situation, etc. In an embodiment, a general program optimized to be used in all situations of relevance for the user (a multi-environment or context independent program) is provided. A specific technical feature parameter setting may e.g. determine spatial filtering (beam forming, directionality) of the electric input audio signal(s) (e.g. including a switching between a directional and an omni-directional mode of operation of the hearing system). An adaptive or fixed behavior of the spatial filtering algorithm may be determined by the specific technical feature parameter setting. A technical feature parameter setting may e.g. determine a noise reduction scheme applied to a signal of the forward path. An adaptive or fixed behavior (or a degree of aggressiveness) of the noise reduction algorithm may be determined by the technical feature parameter setting. A specific technical feature parameters setting may e.g. determine a number of frequency bands to process the electric input signal(s) in.

In the present context, a 'hearing device' refers to a device, such as e.g. a hearing instrument or an active ear-protection device or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing device' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing device may be configured to be worn in any known way, e.g. as a unit arranged behind the ear with a tube leading radiated acoustic signals into the ear canal or with a loudspeaker arranged close to or in the ear canal, as a unit entirely or partly arranged in the pinna and/or in the ear canal, as a unit attached to a fixture implanted into the skull bone, as an entirely or partly implanted unit, etc. The hearing device may comprise a single unit or several units communicating electronically with each other.

More generally, a hearing device comprises an input transducer for receiving an acoustic signal from a user's surroundings and providing a corresponding input audio signal and/or a receiver for electronically (i.e. wired or wirelessly) receiving an input audio signal, a (typically configurable) signal processing circuit for processing the input audio signal and an output means for providing an audible signal to the user in dependence on the processed audio signal. In some hearing devices, an amplifier may constitute the signal processing circuit. The signal processing circuit typically comprises one or more (integrated or separate) memory elements for executing programs and/or for storing parameters used (or potentially used) in the processing and/or for storing information relevant for the function of the hearing device and/or for storing information (e.g. processed information, e.g. provided by the signal processing circuit), e.g. for use in connection with an interface to a user and/or an interface to a programming device. In some hearing devices, the output means may comprise an output transducer, such as e.g. a loudspeaker for providing an air-borne acoustic signal or a vibrator for providing a structure-borne or liquid-borne acoustic signal. In some hearing devices, the output means may comprise one or more output electrodes for providing electric signals.

In some hearing devices, the vibrator may be adapted to provide a structure-borne acoustic signal transcutaneously or percutaneously to the skull bone. In some hearing devices, the vibrator may be implanted in the middle ear and/or in the inner ear. In some hearing devices, the vibrator may be adapted to provide a structure-borne acoustic signal to a middle-ear bone and/or to the cochlea. In some hearing devices, the vibrator may be adapted to provide a liquid-borne acoustic signal to the cochlear liquid, e.g. through the oval window. In some hearing devices, the output electrodes may be implanted in the cochlea or on the inside of the skull bone and may be adapted to provide the electric signals to the hair cells of the cochlea, to one or more hearing nerves, to the auditory cortex and/or to other parts of the cerebral cortex.

A 'hearing system' refers to a system comprising one or two hearing devices, and a 'binaural hearing system' refers to a system comprising two hearing devices and being adapted to cooperatively provide audible signals to both of the user's ears. Hearing systems or binaural hearing systems may further comprise one or more 'auxiliary devices', which communicate with the hearing device(s) and affect and/or benefit from the function of the hearing device(s). Auxiliary devices may be e.g. remote controls, audio gateway devices, mobile phones (e.g. smartphones), public-address systems, car audio systems or music players. Hearing devices, hearing systems or binaural hearing systems may e.g. be used for compensating for a hearing-impaired person's loss of hearing capability, augmenting or protecting a normal-hearing person's hearing capability and/or conveying electronic audio signals to a person.

A hearing aid 'style' refers to a specific type of hearing aid, e.g. a behind-the ear (BTE) hearing aid (e.g. comprising a hearing aid type having a BTE-part acoustically or electrically connected to a part located in the ear canal, e.g. comprising a customized ear mould providing a relatively closed fitting or a loudspeaker with a dome providing a relatively open fitting), or e.g. an in-the-ear (ITE) hearing aid (e.g. consisting of a customized ear mould located at or in the ear canal, e.g. deep in the ear canal). The actual choice of hearing aid style is e.g. dependent on the hearing loss of the user, a closed (ear mould based) fitting being able to compensate a higher hearing loss than a relatively open (e.g. receiver and dome) fitting.

Embodiments of the disclosure may e.g. be useful in applications such as fitting of hearing aids to first time users, where a choice between different hearing aid models having different performance must be made.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

FIG. 4 shows an example of a performance category parameters and corresponding technical feature parameters stored en a memory of a hearing device forming part of a configurable hearing system according the present disclosure, FIG. 5A shows a first example of a number of different technical features and their inclusion in a number of different performance categories of a configurable hearing system according to the present disclosure, FIG. 5B shows a second example of a number of different technical features and their inclusion in a number of different performance categories of a configurable hearing system according to the present disclosure.

Figure 1A:
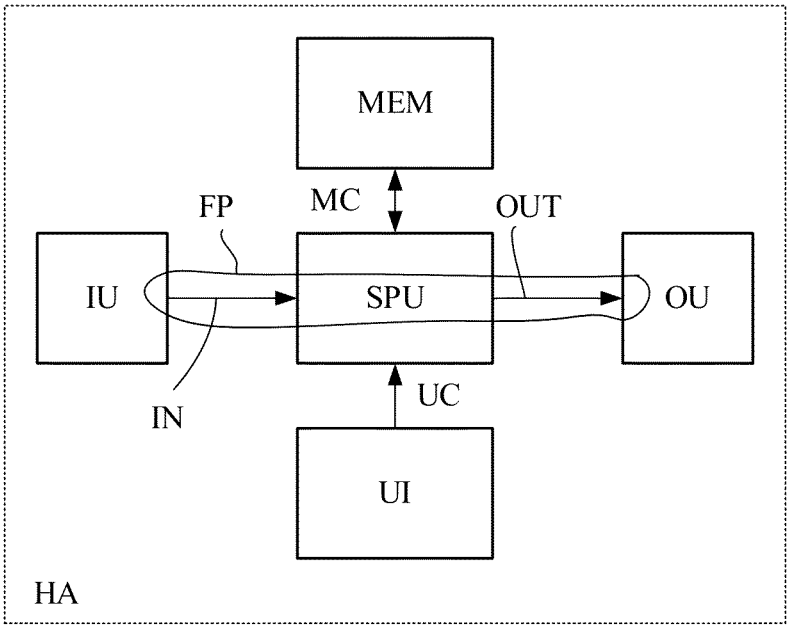
FIG. 1A shows a first embodiment of a configurable hearing system according to the present disclosure.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practised without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

The present application relates to the field of hearing devices, e.g. hearing aids.

The present disclosure deals with the problem of choosing the 'right' hearing aid for a user among a multitude of hearing aids (from a given manufacturer, and of identical style) having different ways of processing an input signal picked up or received by an input unit before availing an enhanced signal to the user via an output unit. The different ways of processing are typically described as different 'features' of the different hearing aids (e.g. noise reduction, directionality, frequency transposition, etc.). Typically, a hearing aid manufacturer offers different hearing aids (of the same style) having different sets of features (e.g. of varying number and/or complexity) under different names (and at different prices). In the present disclosure, such hearing aids of the same style having different feature sets are classified to be in different 'performance categories' (PC). Embodiments of the disclosure are configured to—in a trial period, e.g. less than 3 months—make available the 'feature sets' of hearing aids of different 'performance categories' available for a (possibly first time) hearing aid user in one (configurable) hearing device. The configurable hearing device is adapted to allow a user to activate the feature set of a given hearing aid (performance category) at a given time, and to switch between different hearing aid feature sets (performance categories (e.g. price points)). This has the advantage of allowing a comparison of his or her perception of (at least) two feature sets within a short time (seconds). Such comparison within a short time is essential to the user to provide a relatively 'objective' or 'informed' decision on a preferred feature set (and thus to be able to choose the hearing aid that fits the needs and wishes of the user).

FIG. 1A shows a first embodiment of a configurable hearing system according to the present disclosure. The configurable hearing system comprises a hearing device, e.g. a hearing aid, (HA) adapted to be worn by a user and adapted for processing an input sound signal and/or a directly received auxiliary audio input signal, and providing an enhanced output signal. The hearing device (HA) comprises a forward signal path (FP) comprising an input unit (IU) comprising one or more input transducers and/or one or more wireless receivers for providing respective one or more electric input audio signals (IN) representative of the input sound signal (or of wirelessly received streamed audio signal). The hearing device further comprises a memory (MEM) storing a multitude of different performance category parameter settings each defining a different performance category, each performance category comprising a specific set of technical features. The hearing device (HA) further comprises a configurable signal processing unit (SPU) adapted to access the memory (MEM, via signal MC) and for selecting and processing one or more of the electric input audio signals, based on a currently selected (and loaded) one of the performance category parameter (and corresponding technical feature parameter) settings stored in the memory. The configurable signal processing unit (SPU) provides an enhanced audio signal (OUT). The hearing device (HA) further comprises an output unit (OU) for providing stimuli perceivable by the user as sound based on the enhanced audio signal (OUT) or a signal derived therefrom. The hearing device (HA) further comprises a user interface (UI) in communication with the signal processing unit (SPU, via signal UC) configured to allow the user to select any one of the available different performance category parameter settings to be active at a given time.

Figure 1B:
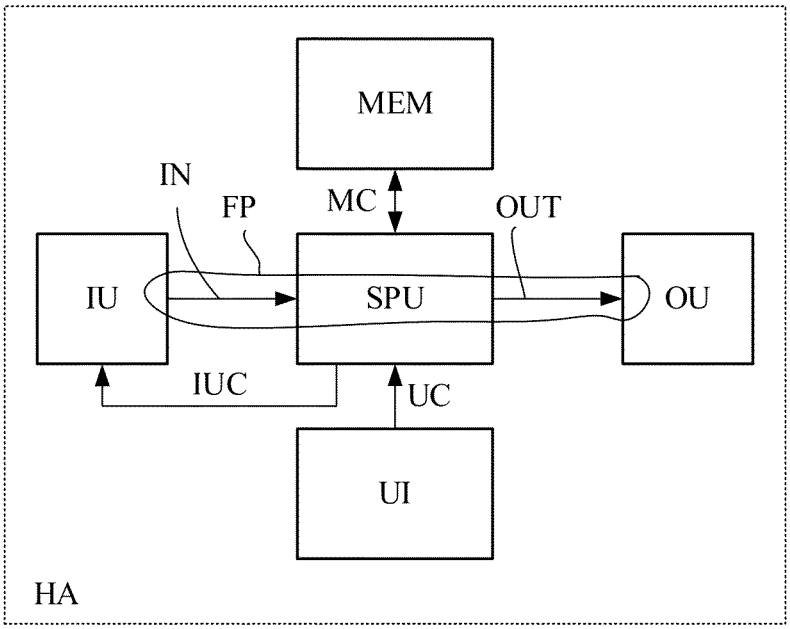
FIG. 1B shows a second embodiment of a configurable hearing system according to the present disclosure.

FIG. 1B shows a second embodiment of a configurable hearing system according to the present disclosure. The second embodiment is identical to the embodiment of FIG. 1A apart from a control signal (IUC) being indicated between the signal processing unit (SPU) and the input unit (IU) and intended to allow the selection of input signals (from available input transducers and wireless receivers) and the bandwidth thereof, e.g. by selecting an appropriate filter characteristic or a sampling rate of an analogue to digital converter.

Figure 2A:
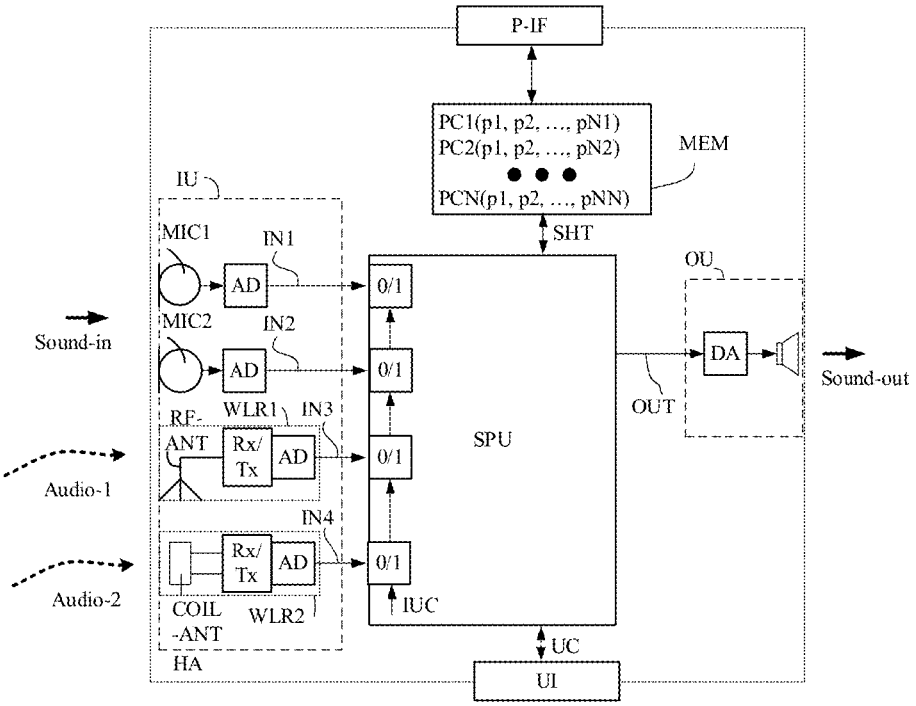
FIG. 2A shows a third embodiment of a configurable hearing system according to the present disclosure.

FIG. 2A shows a third embodiment of a configurable hearing system according to the present disclosure. The third embodiment comprises the same functional units as the first embodiment of FIG. 1A. Additionally a programming interface (P-IF) providing access to a programming device (e.g. a fitting system) allowing configuration parameters to be uploaded to the memory (MEM). Further, some of the functional units are shown in more (exemplary) detail. The illustrated embodiment of the input unit (IU) comprises two input transducers and two wireless transceivers. The two input transducers each comprises respective microphones (MIC1, MIC2) and associated analogue to digital converters (AD) providing electric input audio signals IN1 and IN2, respectively, based on sound signals (Sound-in) impinging on the microphones. The two wireless transceivers (WLR1, WLR2) each comprises respective antenna (RF-ANT, COIL-ANT) and transceiver circuitry (Rx/Tx) and associated analogue to digital converters (AD) providing input signals IN3 and IN4, respectively. A first wireless receiver (RF-ANT, Rx/Tx, AD) is configured to receive (and optionally transmit) electromagnetic signals (Audio-1) based on radiated fields, e.g. at 2.4 GHz, e.g. according to the Bluetooth standard or equivalent. A second wireless receiver (COIL-ANT, Rx/Tx, AD) is configured to receive (and optionally transmit) signals based on near-field communication (Audio-2), e.g. on an inductive coupling between closely located coil antennas (COIL-ANT), e.g. at frequencies below 100 MHz, e.g. around 5 MHz. In an embodiment, the input unit (IU) further comprise time to time-frequency conversion units (e.g. analysis filter banks) to avail the electric input signals IN1-IN4 in a number if frequency bands. In an embodiment, at least a part of the processing of the signal processing unit is performed in a number of frequency bands. In an embodiment, the output unit (OU) comprises a corresponding time-frequency to time conversion unit (e.g. a synthesis filter bank) to provide the output signal in the time domain. Electric input audio signals IN1-IN4 are fed to the signal processing unit (SPU) comprising respective selection units (0/1) for enabling or disabling the individual electric input audio signals (based on performance category parameters of a given—currently active—performance category, indicated by control signal IUC from the signal processing unit). The memory unit (MEM) is shown to have stored specific performance category parameters (p1, p2, . . . pNi) for a number of performance categories PC1, PC2, . . . , PCN), c£ in more detail in FIG. 4, a currently selected one being loaded into the working memory of the signal processing unit (SPU). The output unit OU comprises a digital to analogue converter (DA) for converting the enhanced output signal from the signal processing unit to an analogue signal which is converted to on output sound (Sound-out) by an output transducer (here a loudspeaker). The currently selected performance category is e.g. selected by the user via the user interface (see e.g. FIG. 3B). In an embodiment, the signal processing unit (SPU) further comprises a time control unit adapted to define a usage time duration for which the signal processing unit is adapted to process the electrical input signal in accordance with one of the multitude of different parameter configurations stored in the memory (MEM). In an embodiment, the configurable hearing device (HA) (e.g. the signal processing unit (SPU)) further comprises a data logger adapted to log data comprising duration and/or time stamps indicating an active mode of one of the multitude of different performance categories and/or a performance category specific user satisfaction score. In an embodiment the configurable hearing device (HA) further comprises an environment classification unit for classifying the present acoustic environment of the user (hearing device). Such classification data may advantageously be logged by the data logger together with other usage specific data.

Figure 2B:
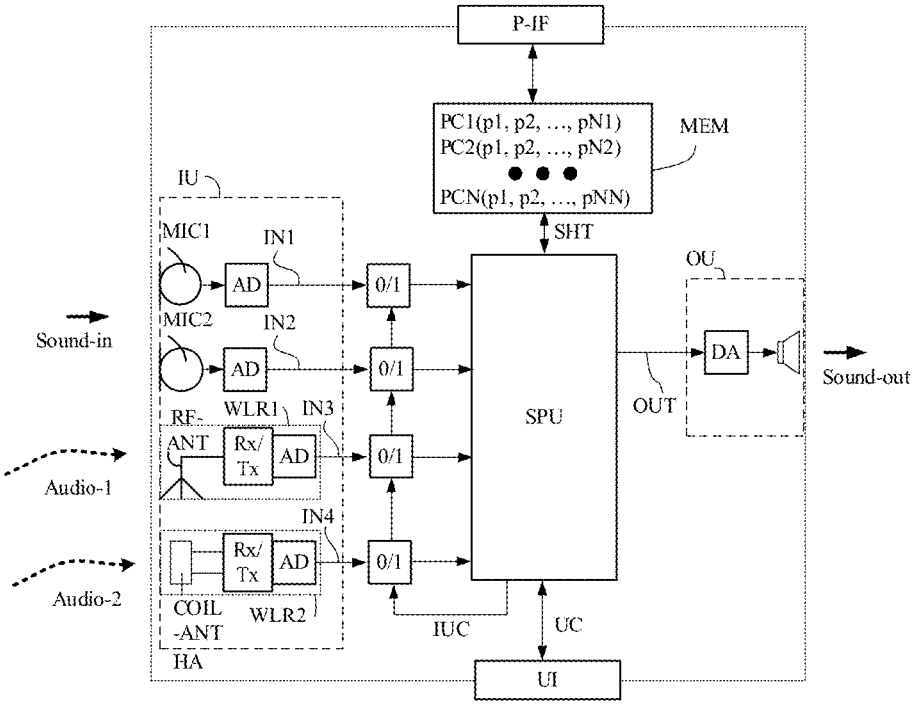
FIG. 2B shows a fourth embodiment of a configurable hearing system according to the present disclosure.

FIG. 2B shows a fourth embodiment of a configurable hearing system according to the present disclosure. The fourth embodiment is identical to the embodiment of FIG. 2A apart from the selection units (0/1) for enabling or disabling the individual electric input audio signals being separate from the signal processing unit (SPU) and a control signal (IUC) being indicated between the signal processing unit (SPU) and the selection units (0/1). The control signal (IUC) is intended to allow the selection of input signals from the input unit (IU). The (fourth) embodiment of FIG. 2B corresponds in structure (system partition) to the (second) embodiment of FIG. 1B.

Figure 3A:
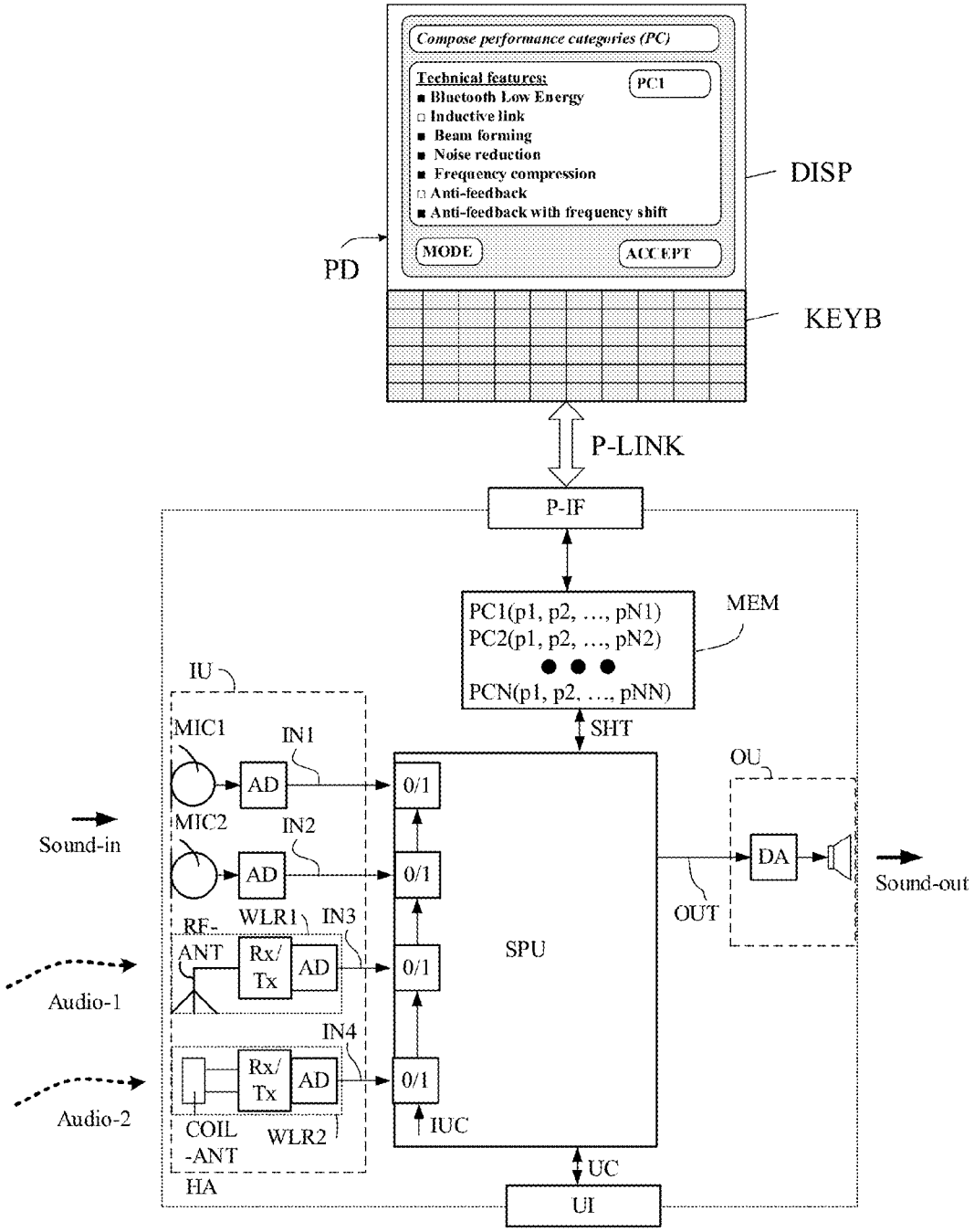
FIG. 3A shows an embodiment of a configurable hearing system according to the present disclosure in communication with a programming device.

FIG. 3A shows an embodiment of a configurable hearing system according to the present disclosure in communication with a programming device. The embodiment of a configurable hearing system shown in FIG. 3A is identical to the (third) embodiment shown in FIG. 2A. A programming device (PD) is (e.g. in a separate fitting session before the configurable hearing system is taken into use by a specific user) connected to the configurable hearing system via a communication link (P-LINK) and a programming interface (P-IF) on the hearing device (HA). The different performance categories and corresponding technical features (and associated parameters) can be composed (selected) in the fitting system (see exemplary screen 'Compose performance categories (PC)' and exemplary performance category 'PC1') as displayed on display screen (DISP) of the programming device (PD) (e.g. a PC). A number of different performance categories can be composed (or selected from a pre-programmed pool of performance categories) and transferred to the memory (MEM) of the hearing device (HA), e.g. using a user interface of the programming device; here exemplified by a keyboard (KEYB) and/or a display (DISP), e.g. a touch sensitive display.

Additionally, the fitting system (PD) may have available user specific data, such as data defining a hearing ability (e.g. hearing loss compared to a normal), e.g. including data from an audiogram, uncomfortable levels, user preferences, etc. In an embodiment, the fitting system comprises a fitting rationale, e.g. NAL (and/or a proprietary fitting algorithm). Based on such fitting rationale, appropriate technical feature parameter settings may be derived for each technical feature of a given performance category (based on knowledge of the technical feature (e.g. comprising one or more algorithms), the user's hearing ability, the hearing device (e.g. its style and specifications of its functional components, such as microphones, loudspeaker, delays, etc.). The fitting system is configured to determine the relevant performance category and technical feature parameters for each performance category (of a given style of a particular hearing device). The thus determined parameters for the different performance categories can be transferred to the hearing device (HA) via the communication link (P-LINK) and a programming interface (P-IF), e.g. wireless interface.

Figure 3B:
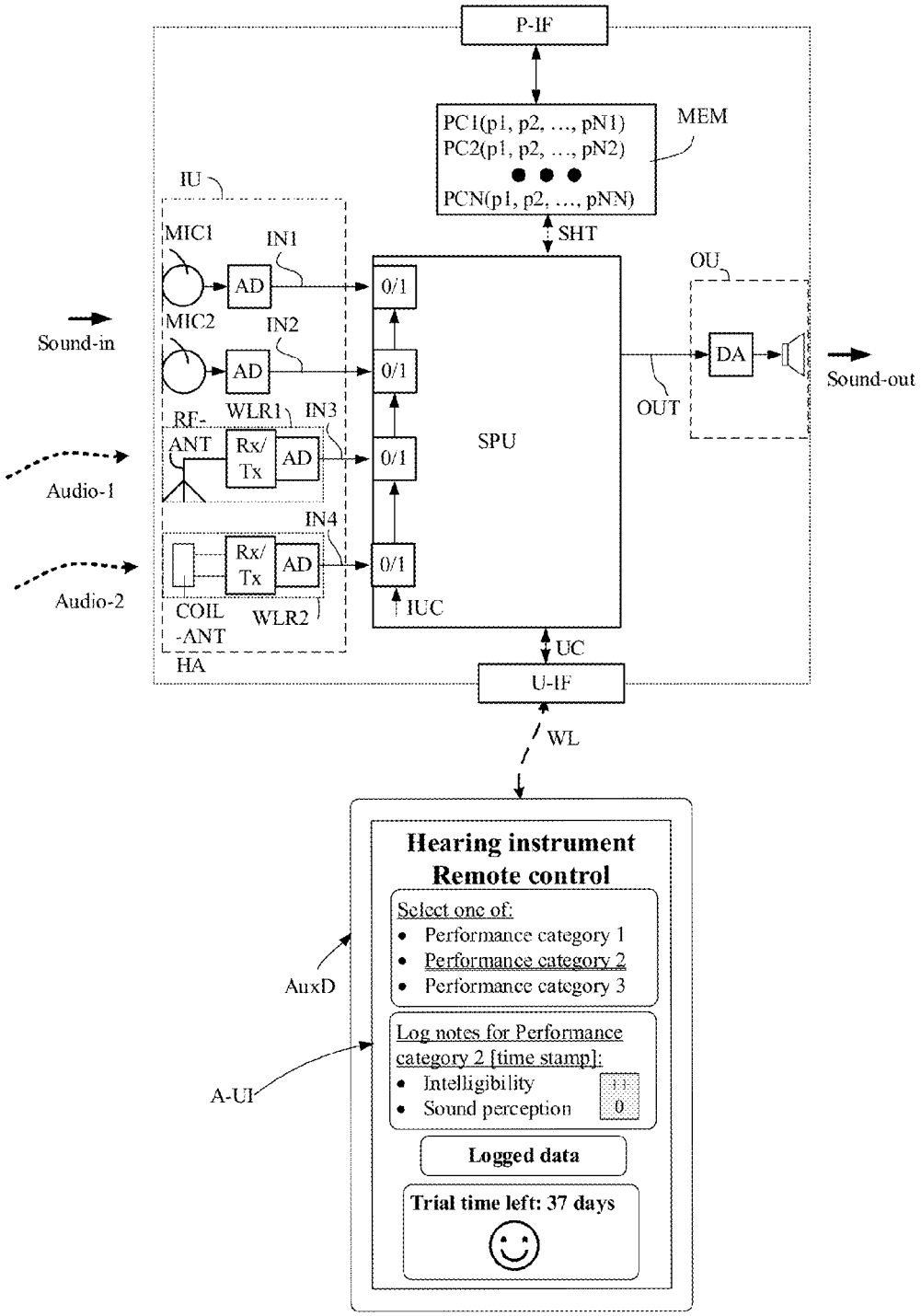
FIG. 3B shows an embodiment of a configurable hearing system according to the present disclosure comprising a separate user interface.

FIG. 3B shows an embodiment of a configurable hearing system according to the present disclosure comprising a separate user interface. The embodiment of a configurable hearing system shown in FIG. 3B is identical to the (third) embodiment shown in FIG. 2A. An auxiliary device (AD), e.g. a communication device (e.g. a remote control or a smartphone) comprising a user inter face (A-UI) to the hearing device is connected to the hearing device via a wireless link (WL) and a hearing device user interface (U-IF). FIG. 3B illustrates the user selection of a given performance category, e.g. via an APP of a smartphone, e.g. a 'Hearing Instrument Remote Control'-APP. Performance category 2 is selected (underlined) in the 'Select one of'-field. The field 'Log notes' provides the user with the option of indicating an opinion on a given performance category (at a given point in time (a time-stamp may be logged together with the opinion and the selected performance category, and possibly other relevant parameters, e.g. acoustic environment data). The field 'Logged data' provides the option for the user to view the data he or she has logged and/or which have been automatically logged about the use of the hearing device, e.g. for a given time period. The field 'Trial time left' indicates to the user the remaining time, for which the current multi-functional hearing device is enabled. In an embodiment, the configurable hearing system is adapted to stop its multi-functionality after expiration of the trial period. In an embodiment, the configurable hearing system is adapted to mute its output when the predefined time period has expired. In an embodiment, the configurable hearing system is adapted to default to a predefined (e.g. its lowest) performance category when the predefined time period has expired.

FIG. 4 shows an example of a performance category parameters and corresponding technical feature parameters stored in a memory (MEM) of a hearing device (HA, cf. FIG. 1-3, 6) forming part of a configurable hearing system according the present disclosure. The memory (MEM) comprises for a number of performance categories (PC1, PC2, . . . , PCN) corresponding to a number of hearing device models ([top level#1], [top level#1], . . . , [low level#NLL]) of a given hearing device style, whose technical features (TF) are available in the hearing device. For a given performance category (e.g. PC1) the set of performance category parameters (e.g. PCP1(1), PCP1(2), . . . , PCP1(NTF), where NTF is the number of available technical features) are stored. The performance category parameters define a specific combination of technical features among the available pool of technical features in the configurable hearing system. Further, the technical features of each performance category (e.g. for PC1: TF11, TF22, . . . , TFNTFPC1, where NTFPC1 is the number of technical features of PC1) are stored together with the technical feature parameter sets (e.g. TFP11(1), TFP11(2), . . . , TFP11(NTF11), where NTF11 is the number of technical feature parameters of technical feature TF11 of performance category PC1) for each of the relevant technical features of the performance category in question.

The performance categories and performance category parameters as well as the associated technical features and the corresponding technical feature parameters are e.g. stored in the memory (MEM) during a fitting session where the configurable hearing system (e.g. the hearing device) is operationally connected (e.g. via a wireless link) to a programming device via a programming interface (cf. e.g. PD and P-IF/P-LINK in FIG. 3A). Alternatively, the performance category parameters and the technical feature parameters may be uploaded to the memory (MEM) of the hearing device during use, e.g. via a cell phone (or other communication device), e.g. via a user interface (e.g. including a specific authorization procedure).

FIG. 5A shows a first example of a number of different technical features (left column in the table of FIG. 5A) and their inclusion in a number of different performance categories (PCi, i=1, 2, . . . , 5, 1st row in FIG. 5A) of a configurable hearing system according to the present disclosure. The technical features Adaptive Noise Reduction Plus, Reverberation Reduction, True Directionality, Environment Optimizer, Soft Noise Management, Transient Noise Reduction, Frequency Composition and Adaptive Directionality all refer to specific algorithms for enhancing the input signal, e.g. to improve speech intelligibility, before presenting a processed signal to the user as perceivable sound. The technical feature Frequency Bandwidth refer to the (possible) quality of the input signal as provided by an input unit of the hearing device. Typically, a relatively large bandwidth of the electric input signal (e.g. corresponding to a large sampling rate of an analogue to digital converter applied to an analogue electric input signal from an input transducer (e.g. a microphone)) is advantageous from a sound quality point of view. All algorithms applied to the electric input signal depend on its bandwidth and are 'exposed to' (have to deal with) any limitations therein (compared to the bandwidth of the sound signal it represents).

In the example of FIG. 5A the technical feature Adaptive Noise Reduction Plus is present in all five performance categories (PC1-PC5), but in different variants of decreasing complexity from performance category PC1 (highest) to performance category PC5 (lowest) and with variations in default state. Such variations may be implemented by slightly different technical feature parameter sets of the algorithm Adaptive Noise Reduction Plus. Similarly, the technical feature Soft Noise Management is also present in all five performance categories (PC1-PC5), but in two different variants of decreasing complexity in performance categories PC1-PC3 (highest, 3 states) and performance categories PC4-PC5 (lowest, 2 states), which again may be implemented by slightly different technical feature parameter sets of the algorithm Soft Noise Management. The technical feature Environment Optimizer is only present in the two higher performance categories PC1, PC1, but in two different variants of decreasing complexity, in PC1 with 5 states (more complex), in PC1 with 5 states (more complex), and in PC2 with 2 states (less complex). The technical feature Environment Optimizer is, however, present in the three lower performance categories PC3-PC5 (as indicated by '-' in the corresponding columns of FIG. 5A).

The technical feature Reverberation reduction is only present in performance category PC1 (indicated in the table of FIG. 5A by '+' in the second column representing the technical features of PC1), whereas this feature is NOT present in any of the other performance categories PC2-PC5 (indicated in the table by '-' in the 3rd to 6th columns representing the technical features of PC2-PC5, respectively). Similarly, the technical features Transient Noise Reduction, Frequency Composition, and Adaptive Directionality are present only in some of the performance categories and absent in others as indicated by '+' and '-', respectively, in the corresponding performance category (PCi) columns.

The technical feature Frequency Bandwidth is present in all five performance categories (PC1-PC5), but in different variants of decreasing width from the relatively higher performance categories PC1, PC2, PC3 (10 kHz) to the relatively lower performance categories PC4, PC5 (8 kHz) as indicated in the individual columns of the table.

In the Example of FIG. 5A, the relatively lower performance categories (PC2-PC5) possess technical features that are a subset of the technical features of the highest performance category (PC1). A given technical feature of a relatively lower performance category may comprise a technical feature in a version that is less complex (or intended to be of lower quality/performance to the user) than the version in the highest performance category. The latter is e.g. exemplified for the technical features Adaptive Noise Reduction Plus, Environment Optimizer, and Soft Noise Management.

FIG. 5B shows a second example of a number of different technical features and their inclusion in a number of different performance categories of a configurable hearing system according to the present disclosure. The example of FIG. 5B is identical to the example of FIG. 5A, except that it comprises two additional technical features Bluetooth Communication and Inductive Communication, respectively. Further, the table shows for each technical feature listed in column 1 a corresponding indication of whether it is present (enabled or disabled) in each of the performance categories PC1-PC5 (in columns 2 to 6, respectively). The presence or absence of a given technical feature in a given performance category is generally indicated by a 1 and 0, respectively (reflecting a performance category parameter, PCP, being equal to 1 or 0, respectively). For the technical features that are present in different variants (Adaptive Noise Reduction Plus, Environment Optimizer, and Soft Noise Management) the presence a given technical feature is indicated by 'PCP=1', whereas the particular variant of the given technical feature is indicated by a technical feature parameter 'TFP=n', where n indicates the number of states of the algorithm in question.

Each of the additional technical features Bluetooth Communication and Inductive Communication are indicated to be present in only some of the performance categories. Bluetooth Communication is only present in the relatively higher performance categories (PC1-PC3), whereas Inductive Communication is only present in the relatively lower performance categories (PC2-PC5). The two features are related to communication (e.g. of audio-, information-, control-signals, etc.) between the hearing device and other devices, e.g. between the hearing device and a contra-lateral hearing device of a binaural hearing system, or an auxiliary device (e.g. a remote control device, a cell phone or other communication device, an audio delivery device, etc.). In an embodiment, the technical feature Bluetooth Communication enables a reception (and/or transmission) of communication signals by the hearing device according to the Bluetooth standard (e.g. classic Bluetooth and/or Bluetooth Low Energy, or related technologies in the frequency range used by Bluetooth (presently 2.4 GHz)). In an embodiment, the technical feature Inductive Communication enables a reception (and/or transmission) of communication signals via an inductive link, e.g. according to a standardized (e.g. NFC) or proprietary scheme.

In the Example of FIG. 5B, two of the performance categories (e.g. PC1 and PC5) of the configurable hearing system each comprises at least one technical feature (Inductive Communication and Bluetooth Communication, respectively) that is not part of the intersection of the two sets of technical features.

A configurable hearing system (comprising a hearing device, e.g. a hearing aid, of a particular style, e.g. BTE, ITE, RITE, CIC, etc.) including the technical features in the 1st column of the tables of FIGS. 5A and 5B and allowing a user to switch between each of the performance categories PC1-PC5 (each availing a specific combination of the available technical features) thus provides the user with the opportunity to try out—in a given acoustic environment—the 'performance' of two or more (such as all) available performance categories. This enables a 'real time' comparison allowing the user to better choose (or identify) a preferred performance category (for the given acoustic situation, and hearing device style).

Figure 6:
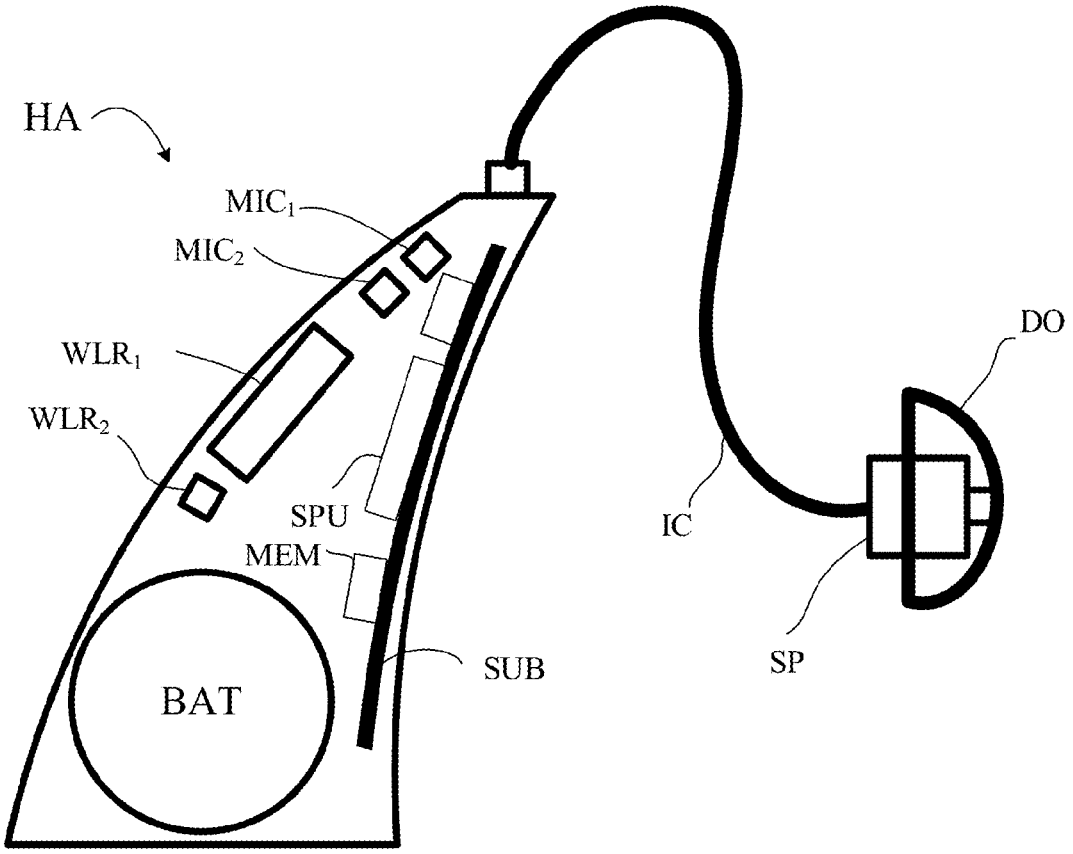
FIG. 6 shows an exemplary hearing device which may form part of a configurable hearing system according to the present disclosure The figures are schematic and simplified for clarity, and they just show details which are essential to the understanding of the disclosure, while other details are left out. Throughout, the same reference signs are used for identical or corresponding parts.

FIG. 6 shows an exemplary hearing device, which may form part of a configurable hearing system according to the present disclosure. The hearing device (HA), e.g. a hearing aid, is of a particular style (sometimes termed receiver-in-the ear, or RITE, style) comprising a BTE-part (BTE) adapted for being located at or behind an ear of a user and an ITE-part (ITE) adapted for being located in or at an ear canal of a user's ear and comprising a receiver (loudspeaker). The BTE-part and the ITE-part are connected (e.g. electrically connected) by a connecting element (IC).

In the embodiment of a hearing device in FIG. 6, the BTE part comprises an input unit comprising two (individually selectable) input transducers (e.g. microphones) (MIC1, MIC2) each for providing an electric input audio signal representative of an input sound signal. The input unit further comprises two (individually selectable) wireless receivers ($WLR_1$, $WLR_2$) for providing respective directly received auxiliary audio input signals. The hearing device (HA) further comprises a substrate SUB whereon a number of electronic components are mounted, including a memory (MEM) storing at least two different performance category parameter settings (see e.g. FIG. 4), each defining a different performance category, each performance category comprising a specific set of technical features. The BTE-part further comprises a configurable signal processing unit (SPU) adapted to access the memory (MEM) and for selecting and processing one or more of the electric input audio signals and/or one or more of the directly received auxiliary audio input signals, based on a currently selected one of the at least two different performance category parameter settings. The configurable signal processing unit (SPU) provides an enhanced audio signal (c£ e.g. signal OUT in FIG. 1), which may be presented to a user or further processed or transmitted to another device as the case may be.

The hearing device (HA) further comprises an output unit (e.g. an output transducer or electrodes of a cochlear implant) providing an enhanced output signal as stimuli perceivable by the user as sound based on said enhanced audio signal or a signal derived therefrom In the embodiment of a hearing device in FIG. 6, the ITE part comprises the output unit in the form of a loudspeaker (receiver) (SP) for converting a signal to an acoustic signal. The ITE-part further comprises a guiding element, e.g. a dome, (DO) for guiding and positioning the ITE-part in the ear canal of the user.

The hearing device (HA) exemplified in FIG. 6 is a portable device and further comprises a battery (BAT) for energizing electronic components of the BTE- and ITE-parts.

In an embodiment, the hearing device, e.g. a hearing aid, is adapted to provide a frequency dependent gain and/or a level dependent compression and/or a transposition (with or without frequency compression) of one or frequency ranges to one or more other frequency ranges, e.g. to compensate for a hearing impairment of a user. In an embodiment, the hearing device comprises a signal processing unit for enhancing the input signals and providing a processed output signal. Various aspects of digital hearing aids are described in [Schaub; 2008].

The hearing device comprises an output unit for providing a stimulus perceived by the user as an acoustic signal based on a processed electric signal. In an embodiment, the output unit comprises a number of electrodes of a cochlear implant or a vibrator of a bone conducting hearing device. In an embodiment, the output unit comprises an output transducer. In an embodiment, the output transducer comprises a receiver (loudspeaker) for providing the stimulus as an acoustic signal to the user. In an embodiment, the output transducer comprises a vibrator for providing the stimulus as mechanical vibration of a skull bone to the user (e.g. in a bone-attached or bone-anchored hearing device).

The hearing device comprises an input unit for providing an electric input signal representing sound. The input unit comprises one or more input transducers (e.g. microphones) ($MIC_1$, $MIC_2$) for converting an input sound to an electric input signal. The input unit comprises one or more wireless receivers ($WLR_1$, $WLR_2$) for receiving (and possibly transmitting) a wireless signal comprising sound and for providing corresponding directly received auxiliary audio input signals. In an embodiment, the hearing device comprises a directional microphone system (beamformer) adapted to enhance a target acoustic source among a multitude of acoustic sources in the local environment of the user wearing the hearing device. In an embodiment, the directional system is adapted to detect (such as adaptively detect) from which direction a particular part of the microphone signal originates.

In an embodiment, the hearing device comprises an antenna and transceiver circuitry for wirelessly receiving a direct electric input signal from another device, e.g. a communication device or another hearing device. In an embodiment, the hearing device comprises a (possibly standardized) electric interface (e.g. in the form of a connector) for receiving a wired direct electric input signal from another device, e.g. a communication device or another hearing device. In an embodiment, the direct electric input signal represents or comprises an audio signal and/or a control signal and/or an information signal. In an embodiment, the hearing device comprises demodulation circuitry for demodulating the received direct electric input to provide the direct electric input signal representing an audio signal and/or a control signal e.g. for setting an operational parameter (e.g. volume) and/or a processing parameter of the hearing device. In general, the wireless link established by a transmitter and antenna and transceiver circuitry of the hearing device can be of any type. In an embodiment, the wireless link is used under power constraints, e.g. in that the hearing device comprises a portable (typically battery driven) device. In an embodiment, the wireless link is a link based on near-field communication, e.g. an inductive link based on an inductive coupling between antenna coils of transmitter and receiver parts. In another embodiment, the wireless link is based on far-field, electromagnetic radiation. In an embodiment, the communication via the wireless link is arranged according to a specific modulation scheme, e.g. an analogue modulation scheme, such as FM (frequency modulation) or AM (amplitude modulation) or PM (phase modulation), or a digital modulation scheme, such as ASK (amplitude shift keying), e.g. On-Off keying, FSK (frequency shift keying), PSK (phase shift keying) or QAM (quadrature amplitude modulation).

In an embodiment, the communication between the hearing device and the other device is in the base band (audio frequency range, e.g. between 0 and 20 kHz). Preferably, communication between the hearing device and the other device is based on some sort of modulation at frequencies above 100 kHz. Preferably, frequencies used to establish a communication link between the hearing device and the other device is below 50 GHz, e.g. located in a range from 50 MHz to 50 GHz, e.g. above 300 MHz, e.g. in an ISM range above 300 MHz, e.g. in the 900 MHz range or in the 2.4 GHz range or in the 5.8 GHz range or in the 60 GHz range (ISM=Industrial, Scientific and Medical, such standardized ranges being e.g. defined by the International Telecommunication Union, ITU). In an embodiment, the wireless link is based on a standardized or proprietary technology. In an embodiment, the wireless link is based on Bluetooth technology (e.g. Bluetooth Low-Energy technology).

In an embodiment, the hearing device is portable device, e.g. a device comprising a local energy source, e.g. a battery, e.g. a rechargeable battery.

In an embodiment, the hearing device comprises a forward or signal path between an input transducer (microphone system and/or direct electric input (e.g. a wireless receiver)) and an output transducer. In an embodiment, the signal processing unit is located in the forward path. In an embodiment, the signal processing unit is adapted to provide a frequency dependent gain according to a user's particular needs. In an embodiment, the hearing device comprises an analysis path comprising functional components for analyzing the input signal (e.g. determining a level, a modulation, a type of signal, an acoustic feedback estimate, etc.). In an embodiment, some or all signal processing of the analysis path and/or the signal path is conducted in the frequency domain. In an embodiment, some or all signal processing of the analysis path and/or the signal path is conducted in the time domain.

In an embodiment, an analogue electric signal representing an acoustic signal is converted to a digital audio signal in an analogue-to-digital (AD) conversion process, where the analogue signal is sampled with a predefined sampling frequency or rate $f_s$, $f_s$ being e.g. in the range from 8 kHz to 40 kHz (adapted to the particular needs of the application) to provide digital samples $x_n$ (or x[n]) at discrete points in time $t_n$ (or n), each audio sample representing the value of the acoustic signal at $t_n$ by a predefined number $N_s$ of bits, $N_s$ being e.g. in the range from 1 to 16 bits. A digital sample x has a length in time of $1/f_s$, e.g. 50 μs, for $f_s$=20 kHz. In an embodiment, a number of audio samples are arranged in a time frame. In an embodiment, a time frame comprises 64 audio data samples. Other frame lengths may be used depending on the practical application.

In an embodiment, the hearing devices comprise an analogue-to-digital (AD) converter to digitize an analogue input with a predefined sampling rate, e.g. 20 kHz. In an embodiment, the hearing devices comprise a digital-to-analogue (DA) converter to convert a digital signal to an analogue output signal, e.g. for being presented to a user via an output transducer.

In an embodiment, the hearing device, e.g. the microphone unit, and or the transceiver unit comprise(s) a TF-conversion unit for providing a time-frequency representation of an input signal. In an embodiment, the time-frequency representation comprises an array or map of corresponding complex or real values of the signal in question in a particular time and frequency range. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the frequency domain. In an embodiment, the frequency range considered by the hearing device from a minimum frequency $f_{min}$ to a maximum frequency $f_{max}$ comprises a part of the typical human audible frequency range from 20 Hz to 20 kHz, e.g. a part of the range from 20 Hz to 12 kHz. In an embodiment, a signal of the forward and/or analysis path of the hearing device is split into a number NI of frequency bands, where NI is e.g. larger than 5, such as larger than 10, such as larger than 50, such as larger than 100, such as larger than 500, at least some of which are processed individually. In an embodiment, the hearing device is/are adapted to process a signal of the forward and/or analysis path in a number NP of different frequency channels (NP≤NI). The frequency channels may be uniform or non-uniform in width (e.g. increasing in width with frequency), overlapping or non-overlapping.

In an embodiment, the hearing device comprises a detector for classifying a current acoustic environment of the user (hearing device).

In an embodiment, the hearing device comprises a level detector (LD) for determining the level of an input signal (e.g. on a band level and/or of the full (wide band) signal). The input level of the electric microphone signal picked up from the user's acoustic environment is e.g. a classifier of the environment. In an embodiment, the level detector is adapted to classify a current acoustic environment of the user according to a number of different (e.g. average) signal levels, e.g. as a HIGH-LEVEL or LOW-LEVEL environment.

In a particular embodiment, the hearing device comprises a voice detector (VD) for determining whether or not an input signal comprises a voice signal (at a given point in time). A voice signal is in the present context taken to include a speech signal from a human being. It may also include other forms of utterances generated by the human speech system (e.g. singing). In an embodiment, the voice detector unit is adapted to classify a current acoustic environment of the user as a VOICE or NO-VOICE environment. This has the advantage that time segments of the electric microphone signal comprising human utterances (e.g. speech) in the user's environment can be identified, and thus separated from time segments only comprising other sound sources (e.g. artificially generated noise). In an embodiment, the voice detector is adapted to detect as a VOICE also the user's own voice. Alternatively, the voice detector is adapted to exclude a user's own voice from the detection of a VOICE.

In an embodiment, the hearing device comprises an own voice detector for detecting whether a given input sound (e.g. a voice) originates from the voice of the user of the system. In an embodiment, the microphone system of the hearing device is adapted to be able to differentiate between a user's own voice and another person's voice and possibly from NON-voice sounds.

In an embodiment, the hearing device comprises an acoustic (and/or mechanical) feedback suppression system. Adaptive feedback cancellation has the ability to track feedback path changes over time. It is based on a linear time invariant filter to estimate the feedback path but its filter weights are updated over time. The filter update may be calculated using stochastic gradient algorithms, including some form of the Least Mean Square (LMS) or the Normalized LMS (NLMS) algorithms. They both have the property to minimize the error signal in the mean square sense with the NLMS additionally normalizing the filter update with respect to the squared Euclidean norm of some reference signal.

In an embodiment, the hearing device further comprises other relevant functionality for the application in question, e.g. compression, noise reduction, etc.

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

REFERENCES

[Schaub; 2008] Arthur Schaub, Digital hearing Aids, Thieme Medical. Pub., 2008.

The invention claimed is:

1. A configurable hearing system that allows a user to compare perception of different hearing aid models corresponding to different performance categories in multiple acoustic environments, the system comprising a hearing device, e.g. a hearing aid, adapted to be worn by a user and adapted for processing an input sound signal and/or a directly received auxiliary audio input signal, and providing an enhanced output signal, the hearing device comprising a memory storing at least two different performance categories, each comprising a set of technical features representative of a different hearing aid model, each set of technical features including at least one technical feature that is not part of the intersection of the two sets of technical features and each technical feature of the group of technical features being defined by specific parameter settings intended for use in all acoustic situations;

a forward signal path comprising an input unit comprising one or more input transducers for providing respective one or more electric input audio signals representative of said input sound signal and/or one or more wireless receivers for providing respective one or more directly received auxiliary audio input signals;

a configurable signal processing unit adapted to access the memory and for selecting and processing one or more of said electric input audio signals and/or one or more of said directly received auxiliary audio input signals, based on the set of technical features corresponding to the performance category representing a currently selected one of the different hearing aid models, said configurable signal processing unit providing an enhanced audio signal;

an output unit for providing said enhanced output signal as stimuli perceivable by the user as sound based on said enhanced audio signal or a signal derived therefrom; and a user interface configured to allow a user to select any one of said at least two different performance categories comprising a set of technical features representative of a different hearing aid model to be active at a given time;

wherein the hearing device is configured to provide that at least some of said technical features can be enabled or disabled as part of the specific performance category parameter setting.

2. A configurable hearing system according to claim 1 wherein said technical features comprise at least one of providing a specific sampling rate of the input sound signal, providing a specific number of electric input audio signals, providing a specific bandwidth of said electric input audio signal(s), providing a specific number of directly received auxiliary audio input signals, providing an ability of receiving an audio signal from a wireless transmitter, providing said electric input audio signal(s) and/or said directly received auxiliary audio input signals in a specific number of frequency bands, or a combination thereof.

3. A configurable hearing system according to claim 1 wherein the selected performance category and its specific set of technical features provides a specific selection of electric input audio signals and directly received auxiliary audio input signals and provides a specific processing thereof.

4. A configurable hearing system according to claim 1 comprising a programming interface for uploading or modifying technical features of one or more of said performance categories to the memory.

5. A configurable hearing system according to claim 1 comprising a time control unit allowing said control by the user to select any one of said multitude of different selectable performance categories to be active to be limited to a predefined or dynamically updatable functional time period.

6. A configurable hearing system according to claim 1 comprising a data logger for logging the users' selection of performance categories.

7. A configurable hearing system according to claim 1 wherein, the parameter configuration, utilized by the signal processor to process the input electrical signal, comprised in each of the at least two different parameter configurations comprises context independent adjustments of the ranges and/or settings.

8. A configurable hearing device such as a hearing aid comprising:

an input transducer adapted to transform an input sound signal to an electrical input signal;

a memory storing at least two different performance categories, each comprising a group of technical features representative of a different hearing aid model from the same product family, the group of technical features of each of the at least two different performance categories including at least one technical feature that is not part of the intersection of the groups of technical features and each technical feature of the group of technical features being defined by a selectable range and/or parameter settings;

a signal processing unit adapted to access the memory and to process the electrical input signal in accordance with an active performance category selectable from the at least two different performance categories, the signal processing unit providing a processed electrical signal; and an output transducer adapted to transform the processed electrical signal to an output signal producing a hearing perception to a user of the hearing device.

9. A configurable hearing device according to claim 8 further comprising a time control unit adapted to define a usage time duration for which the signal processing unit is adapted to process the electrical input signal in accordance with one of the at least two different parameter configurations.

10. A configurable hearing device according to claim 8 further comprising an interface comprising a user interface adapted to receive a user selection for activating one of the at least two different performance categories.

11. A configurable hearing device according to claim 8 further comprising a data logger adapted to log data comprising duration and/or time stamps indicating an active mode of one of the at least two different performance categories and/or a performance category specific user satisfaction score.

12. A configurable hearing device according to claim 8 further comprising an environment classification unit adapted to classify the user's acoustic environment as a classification signal.

13. A configurable hearing device according to claim 9 wherein the usage time duration is extendible in response to a user's extension request.

14. A configurable hearing device according to claim 8 further comprising a receiving unit adapted to receive, in response to a user's service request, an executable activation instruction, which when executed alters at least one performance category to enable or disable a technical feature and/or to extend or limit the selectable range and/or parameter setting.

15. A configurable hearing device according to claim 8 wherein at least one performance category of the at least two different performance categories comprises a plurality of context dependent programs comprising a subset of the features and range and or parameter settings of the features and range and/or settings specific to the at least one performance category, wherein the context dependent programs are at least partially overlapping across the at least two performance categories.

16. A configurable hearing device according to claim 8 comprising a hearing aid, a headset, an earphone, an ear protection device or a combination thereof.

17. Use of a configurable hearing system as claimed in claim 1 or a configurable hearing device such as a hearing aid comprising an input transducer adapted to transform an input sound signal to an electrical input signal;

a memory storing at least two different performance categories, each comprising a group of technical features representative of a different hearing aid model from the same product family, the group of technical features of each of the at least two different performance categories including at least one technical feature that is not part of the intersection of the groups of technical features and each technical feature of the group of technical features being defined by a selectable range and/or parameter settings;

a signal processing unit adapted to access the memory and to process the electrical input signal in accordance with an active performance category selectable from the at least two different performance categories, the signal processing unit providing a processed electrical signal; and an output transducer adapted to transform the processed electrical signal to an output signal producing a hearing perception to a user of the hearing device.

* * * * *